US005104194A

United States Patent [19]

LeBegue et al.

[11] Patent Number: 5,104,194

[45] Date of Patent: Apr. 14, 1992

[54] CONTINUOUS MINER WITH IMPROVED DUCT SYSTEM AND METHOD OF INCREASING DUCT CROSS SECTION

[75] Inventors: Maurice K. LeBegue; Clarence H. Woodford, II; Leonard M. Sanders; John A. Baird, all of Fairmont, W. Va.

[73] Assignee: Tamrock World Corporation, N.V., Curacao, Netherlands Antilles

[21] Appl. No.: 640,259

[22] Filed: Jan. 11, 1991

[51] Int. Cl.[5] ..... F21G 35/22; F21F 5/20

[52] U.S. Cl. ..... 299/12; 299/64; 454/172; 454/903

[58] Field of Search ..... 299/12, 64; 98/50, DIG. 7

[56] References Cited

U.S. PATENT DOCUMENTS 4,289,509 9/1981 Hölter ..... 299/12 X

FOREIGN PATENT DOCUMENTS 2349454 4/1974 Fed. Rep. of Germany ..... 299/64

769013 12/1980 U.S.S.R. ..... 98/50

*Primary Examiner*—David J. Bagnell

*Attorney, Agent, or Firm*—Stanley J. Price, Jr.

[57] ABSTRACT

A self-propelled continuous mining machine which includes a mobile frame assembly having a material dislodging device, and a conveying system. A dust collecting system is positioned on the mobile frame assembly for inducing a flow of air through a duct system. As material is dislodged from a mine face, the dust collecting system draws airborne dust created by the dislodging device through the duct system and into the collecting system mounted on the mobile frame assembly. The duct system has two sets of vertical walls each connected to and spaced by a horizontal wall with one set of vertical walls fitting channel-like into the other set of vertical walls. The duct assembly has a gasket, seal or other means of preventing airborne dust from escaping through the two sets of vertical walls. The duct assembly is expandable to increase the capacity of the duct system.

13 Claims, 4 Drawing Sheets

CONTINUOUS MINER WITH IMPROVED DUCT SYSTEM AND METHOD OF INCREASING DUCT CROSS SECTION

BACKGROUND OF THE INVENTION

1. Field Of The Invention

This invention relates to a continuous miner, and more particularly, to a continuous miner that includes a dust scrubber system for dust control having ductwork in the duct system that increases in capacity during operation of the scrubber system.

2. Description Of The Prior Art

In underground mining, it is well known to provide a continuous mining machine which includes a material dislodging mechanism positioned on the front end of the mining machine for dislodging material from a mine face. The dislodged material is conveyed rearwardly of the mining machine by a conveying means positioned on the continuous mining machine. The continuous mining machine is designed to continuously advance and dislodge material being mined to form an entry or tunnel in the material seam.

Various types of continuous mining machines having different types of duct assemblies are known.

U.S. Pat. No. 3,712,678 discloses a continuous miner which is provided with a dust collecting means comprising ductwork adapted to receive dust entrained air adjacent to and rearwardly of the material dislodging device and mobile frame carried ductwork operable to alternatively discharge the exhaust air to opposite sides of the machine. U.S. Pat. No. 3,792,568 discloses a continuous mining machine with an air scrubber including a duct located adjacent the mine face for removing the dust laden air at the mine face, a scrubber mechanism operatively connected to the duct for separating the dust from the air moving through the duct, and a second duct operatively connected to the scrubber mechanism for directing the resultant clean air back toward the mine face.

U.S. Pat. No. 3,810,677 discloses a mining machine having a boom enclosed dust collector assembly for use in a coal mining operation wherein the dust-laden air from a mining machine is gathered directly from said operation, collected in the mining machine boom and selectively wetted and separated by centrifugal processing into a coal slurry for disposal and clean air for exhaust.

U.S. Pat. No. 4,076,315 discloses a dust collecting device including an intake means for delivering air to a rotating fan where the dust-laden air is wetted and an outlet means directing air and slurry from the fan and into a curtain to an area of dust concentration.

U.S. Pat. No. 4,157,204 discloses a coal mine ventilation system which ensures proper ventilation near the working area of a mining machine. The mining machine has mounted on it a panel on a movable frame, a conventional line curtain fixed to the mine floor and roof and located adjacent to the panel and a fluid spray system to direct a flow of air across the mine face and into the curtain.

U.S. Pat. No. 4,249,778 discloses a mining machine with an air-cleaning system comprising ducting for conducting dust-laden air, a scrubber for applying liquid to the dust-laden air, and a demister for thereafter removing moisture from the air. The outlet of the demister is higher than the inlet opening to create a dead air space which aids in preventing the reentrainment of moisture in the exhaust air.

U.S. Pat. No. 4,380,353 discloses a dust control system for a mining machine for controlling respirable dust in coal mining operations, compriisng a ductwork system having intakes adjacent to the cutter head of the mining machine, a fan for drawing air through the ductwork system, a flooded bed scrubber in the ductwork system upstream from the fan for suspending the dust particles in solution and a demister with a sump system for directing the dust-laden water to a point adjacent the material dislodging mechanism. Also disclosed is a hinged and telescoping duct system associated with the dust control system.

U.S. Pat. No. 4,463,973 discloses a dust collecting device for use in mining machines which is connected to a suction source and which opens near the cutting area of a mining machine. The dust collecting device has two duct sections movable relative to each other. One duct section is mounted on the cutter boom of the mining machine and has an extendable upper wall, connected through a hinged plate, that abuts a wall of the first duct section which is mounted on the mining machine body. A lower hinge plate connected to the bottom wall of the duct swivels freely and rests on the bottom wall of the first duct to enclose the space between the two duct sections.

U.S. Pat. No. 4,531,784 discloses a continuous mining machine having a dust collector including a housing having a plurality of laterally spaced inlets for receiving dust-laden air, and a duct system connecting the inlets to corresponding outlets where the air with substantially all of the dust removed therefrom is discharged. A plurality of water spray manifolds are positioned in the housing at the inlets and direct a high pressure liquid spray toward the outlets to induce an accelerated flow of dust-laden air into the dust collector.

U.S. Pat. No. 4,557,524 discloses a mining machine having a dust collection system mounted on the boom and mobile frame of the mining machine with a transition section connecting the intake on the boom and the fixed duct section on the mobile frame. The transition section consists of a two piece arrangement wherein each piece is hinged to the intake duct section and is capable of slidingly engaging the end of the fixed duct section adjacent the boom to connect and seal the intake duct section to the fixed duct section as the boom pivots upwardly and downwardly.

U.S. Pat. No. 4,840,432 discloses a self-propelled continuous mining machine with a dust collecting system positioned on the mobile frame assembly for inducing a flow of air through a hollow interior portion of the boom assembly connected by an arcuate pivot joint to the dust collecting system on the mobile frame.

Although the prior art continuous mining machines include various types of ductwork systems, it does not disclose an increasable capacity ductwork system and there is a need for an improved mining machine having an increasable capacity ductwork system such as a channel system with a movable top or a rigid lower structure with a flexible top which can inflate or expand to increase the cross section of the scrubber ducts while mining, yet retaining a lower collapsed height for tramming purposes.

SUMMARY OF THE INVENTION

In accordance with the present invention, there is provided a continuous mining machine for use in an underground mine which includes a mobile frame assembly, a material dislodging means extending from the frame assembly, a conveying means having a conveying reach and a return reach, and a dust collecting system for collecting airborne dust particles produced as the material dislodging means mounted on the front end of the mobile frame dislodges material from the mine face.

The dust collecting system has a fan assembly, a dust collector and a ductwork assembly positioned on the mobile frame to induce a flow of air through the ductwork. The duct assembly has an inlet and an outlet. The portion of the duct assembly having the inlet is positioned between the fan assembly and the boom assembly and the duct assembly having the outlet is connected to the fan assembly opposite the side of the fan assembly having the inlet to exhaust the cleaned air. The ductwork is expandable to increase duct cross section while the continuous mining machine is operating and collapsible for tramming purposes when the continuous mining machine is being positioned in the mine.

In one embodiment of the invention, the duct assembly has a first set of two vertical walls extending longitudinally upon the mobile frame spaced by and connected to a horizontal wall that forms a bottom wall. Set channel-like into this first set of vertical walls is a second set of vertical walls, which are parallel to the first set of vertical walls. The second set of vertical walls are spaced by and connected to a horizontal wall forming a top wall.

There is a mechanical means for raising the second set of vertical walls to increase the cross section of the duct assembly while the machine is operating and the duct assembly may be collapsed while the machine is not operating for tramming purposes. Leakage of the dust entrained air is prevented by a scraper seal, a rolling seal, a gasket, ar inflatable seal, a bladder used as a seal and as a means to lift the second set of vertical walls of the duct assembly or by other mechanical means.

The duct assembly includes a transition section connecting the fan assembly with the exhaust end of the duct assembly. The exhaust end of the duct assembly runs under the conveyor system transversely to the longitudinal axis of the mining machine frame to discharge on either side of the mining machine.

The exhaust duct assembly first set of outer or vertical walls has reinforcing cross bars connected to the end of the outer set of vertical walls opposite the horizontal bottom wall. The second or inner set of vertical walls has corresponding cut-out portions to allow the exhaust duct assembly to be expanded and contracted by hydraulic or other mechanical means.

In another embodiment of the invention, the duct assembly has two vertical walls connected to and spaced by a horizontal bottom wall. The end of the vertical wall opposite the end of the vertical walls connected to the horizontal bottom wall is connected to a flexible top portion. This flexible top portion can expand while the mining machine is operating due to the air pressure created by the fan assembly or by mechanical means or inflatable ribs integral with the flexible top member.

In another embodiment of the invention, the intake duct assembly is connected to the fan assembly by means of a duct having a horizontal top wall, a horizontal bottom wall and two vertical side walls. The horizontal top wall has a cut-out portion held in place by levers or other appropriate means. The cut-out portion has two vertical sides and a curved end wall extending into the interior of the transition duct assembly in the unexpanded state. In the expanded state, the cut-out portion of the top wall is moved upwardly and forwardly by means of guides, rollers, levers or other appropriate mechanical means to connect with the fan assembly or ductwork leading to the fan assembly. A bottom plate connected to the cut-out portion of the top wall separates the duct assembly into two channels.

In another embodiment of the invention, the intake duct assembly is connected to the fan assembly by means of a duct having a horizontal top wall, two vertical side walls, and a horizontal bottom wall. The horizontal top wall has a cut-out area covered by and connected to a flexible covering that expands when the continuous mining machine is operating by means of integral inflatable ribs or by other mechanical means.

In another embodiment of the invention, the duct intake portion has a horizontal top wall, a horizontal bottom wall and two vertical side walls. There is a cut-out portion of the top wall which is hingedly attached to the top wall of the duct intake portion. The cut-out portion has vertical side walls connected to an end wall which protrude into the interior of the intake duct assembly in the unexpanded state. The hinged cut-out portion of the top wall may be rotated outwardly around the hinge mechanically, by hand, or in response to air pressure from the fan assembly to increase the cross section of the intake duct assembly when the continuous miner is in operation.

Accordingly, the principal object of the present invention to provide a continuous mining machine which includes a duct assembly having the capacity to expand by means of a duct having two vertical walls connected to and spaced by a horizontal bottom wall into which is set channel-like a second set of vertical walls connected to and spaced by a horizontal top wall.

Another object of the present invention is to provide an expandable duct for use with a continuous mining machine that has vertical side walls spaced by and connected to a horizontal bottom wall with an expandable top of a flexible material.

Yet another object of the present invention is to provide an expandable duct for use with a continuous mining machine that is expandable by means of a hingedly connected cut-out portion.

Still yet another object of the present invention is to provide an expandable duct for a continuous mining machine having a cut-out portion attached to the duct with a plate generally parallel to and attached to the cut-out portion so that when the cut-out portion is raised to increase duct capacity, the plate divides the inside of the duct into two channels.

These and other objects of the present invention will be more completely disclosed and described in the following specifications, the accompanying drawings and the appended claims.

DESCRIPTION OF THE PREFERRED EMBODIMENTS

Figure 1:
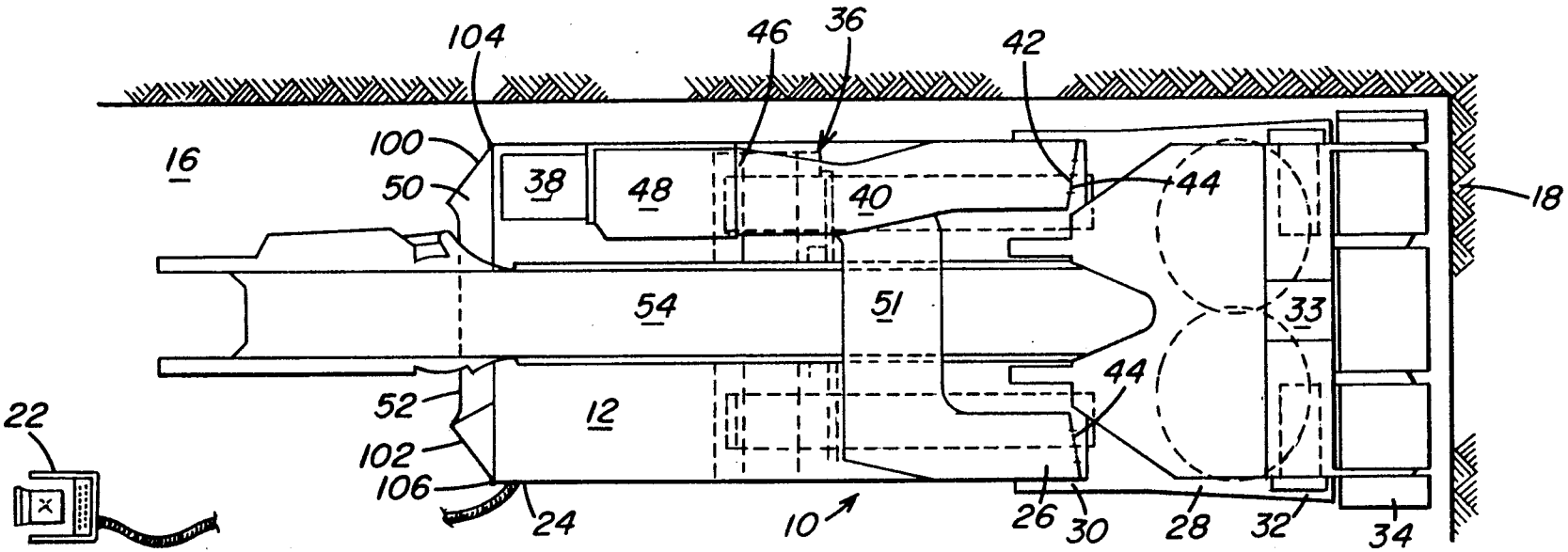
FIG. 1 is a top plan view of one embodiment of a self-propelled continuous mining machine which is the subject of this invention.
Figure 2:
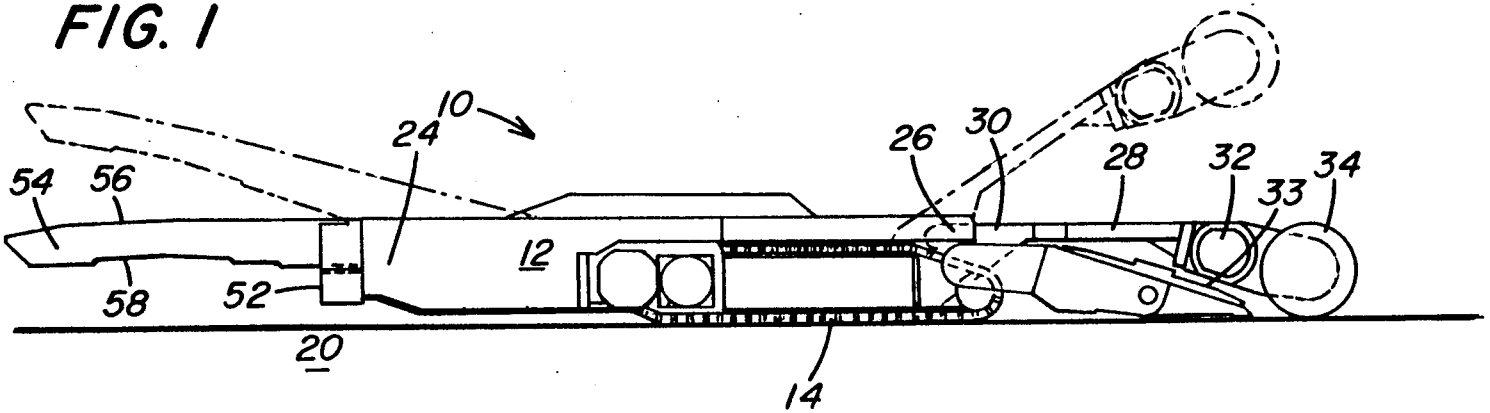
FIG. 2 is a view in side elevation of the continuous mining machine shown in FIG. 1, illustrating a boom assembly having a dislodging head secured thereto resting on a mine floor, and illustrating in phantom the boom assembly and conveyor assembly pivoted upwardly relative to the mining machine to show the extent of travel of the boom assembly and conveyor assembly.

Referring to the drawings, and particularly to FIGS. 1 and 2, there is illustrated a continuous mining machine generally designated by the numeral 10 for use in an underground mine 16 to dislodge material from the mine face 18. Continuous mining machine 10 includes a mobile frame assembly 12 and a pair of ground engaging traction means 14 positioned at each side of mobile frame assembly 12 for propelling mining machine 10 within a mine 16 along the floor 20 thereof.

Continuous mining machine 10 is capable of being operated from an operator's station 22 in a manner similar to other such machines or from an operator's compartment on continuous mining machine 10 to dislodge material from a mine face 18 and transport it rearwardly of the rear end 24 of mining machine 10. Accordingly, mining machine 10 includes operating controls and sources of power for operating ground engaging traction means 14 and other equipment included thereon.

Mining machine 10 includes a boom assembly 28 having a first end portion 30 secured to the front end 26 of mobile frame assembly 12. Boom assembly 28 also includes a second end portion 32. As seen in FIGS. 1 and 2 a material dislodging head 34 is connected to boom assembly 28 second end section 32. Although a material dislodging head 34 such as dislodging head 34 is illustrated in the figures it should been understood that any desired dislodging mechanism known in the art may be utilized.

Mining machine 10 also includes a dust collecting system generally designated by the numeral 36. The dust collecting system 36 is operable to remove airborne particles produced as the dislodging head 34 dislodges material from mine face 18 to provide a substantially dust free working environment for the mining machine operator. Dust collecting system 36 includes a fan assembly 38 mounted on mobile frame assembly 12 at the rear end 24 of mining machine 10. Duct assembly 40, which runs longitudinally along a side of mobile frame assembly 12, has an end portion 42 connected to an air inlet 44 and an opposite end portion 46 which is connected to a dust scrubber or collector 48 on frame assembly 12. Dust collector 48 is also positioned on mobile frame assembly 12 and is connected to fan assembly 38. Duct assembly 40 is connected by a transition section 50 to a rear crossover duct assembly 52 which is connected to the fan assembly 38 on the mobile frame assembly 12. Rear crossover duct assembly 52 traverses the rear end 24 of the mining machine 10 to discharge the dust free air on either side of the mining machine 10 on which the duct 40 is positioned, and duct assembly 52 passes under the conveyor means 54. As illustrated at the rear end 24 of the mining machine 10 the conveying means 54 has a conveying reach 56 and a conveying reach return 58.

As illustrated in FIGS. 3 through 7, duct assembly 40 has a first set of generally parallel vertical side walls 60 spaced by and connected to a horizontal bottom wall 62. A second set of generally parallel vertical side walls 64 are spaced by and connected to a horizontal top wall 66. The second set of vertical side walls 64 fit channel-like into the first set of vertical side walls 60. The cross section of duct assembly 40 may be increased by raising horizontal top wall 66 by mechanical means such as levers, hydraulic pistons, etc., while the abutment of the second set 64 and first set 60 of vertical side walls enclose the interior of duct 40. Various seals between the vertical walls, hereinbelow detailed, seal the interior of duct 40.

Figure 3:
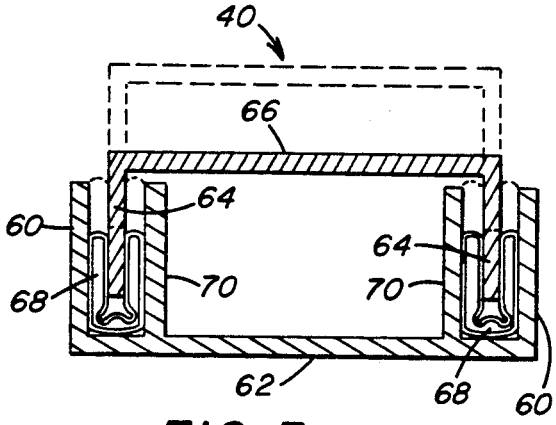
FIG. 3 is a view in cross section of one embodiment of an expandable duct with an inflatable bladder, illustrating in phantom the duct in the expanded state.

In the embodiment of FIG. 3, the duct assembly 40 has an inflatable bladder 68 positioned between the first set of vertical side walls 60 and a third set of vertical side walls 70 connected to the horizontal bottom wall 62 parallel to the first set of vertical side walls 60. An inflatable bladder 68 is positioned between the first set 60 and the third set 70 of vertical side walls. The second set of vertical side walls 64 fit channel-like between the first set 60 and the third set 70 of the vertical side walls. Inflatable bladder 68 provides a seal to prevent leakage of dust and also provides a means for raising the horizontal top wall 64 to increase the cross section of duct 40.

Figure 4A:
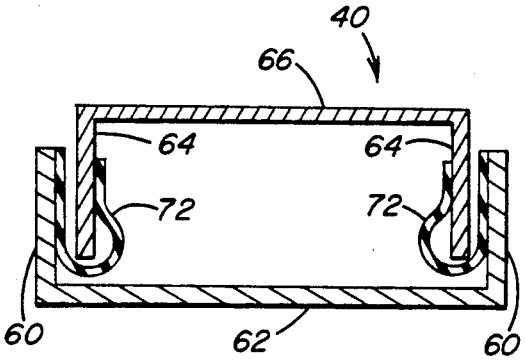
FIG. 4A is a view in cross section of one embodiment of an expandable duct with a roller seal.
Figure 4B:
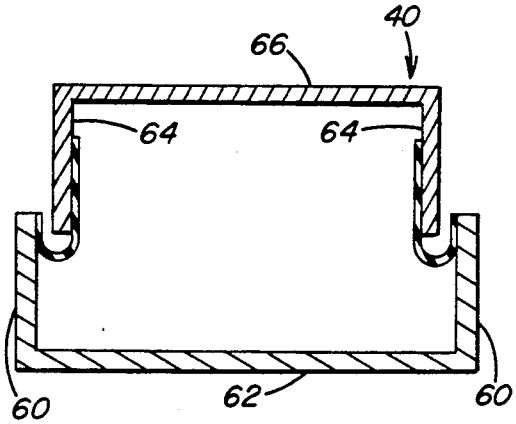
FIG. 4B is another view in cross section of one embodiment of an expandable duct with a roller seal in the expanded state.

In the embodiment of FIGS. 4A and 4B, the duct assembly 40 is sealed by a rolling seal 72 attached to the inside surface of the first set of vertical side walls 60 and to the inside surface of the second set of vertical side walls 64.

Figure 5:
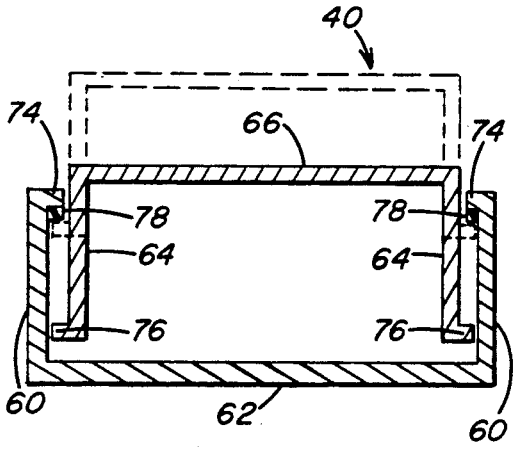
FIG. 5 is a view in cross section of one embodiment of an expandable duct with a gasket positioned on a lip portion of the first set of vertical walls and illustrating in phantom the duct in the expanded state.

In the embodiment of FIG. 5 the duct assembly 40 has the second set of vertical walls 64 set channel-like into the first set of vertical walls 60. The second set of vertical walls 64 are connected to and spaced by a horizontal top wall 66. The first set of vertical walls 60 is connected to and spaced by the horizontal bottom wall 62. The first set of vertical walls 60 has a lip portion 74 directed inwardly toward the second set of vertical walls 64. In the angle formed between the lip 74 and the first vertical wall 60 is a gasket 78 which, as illustrated in phantom, makes contact with the outwardly directed lip 76 on the second set of vertical walls 64 when the duct 40 expands.

Figure 6:
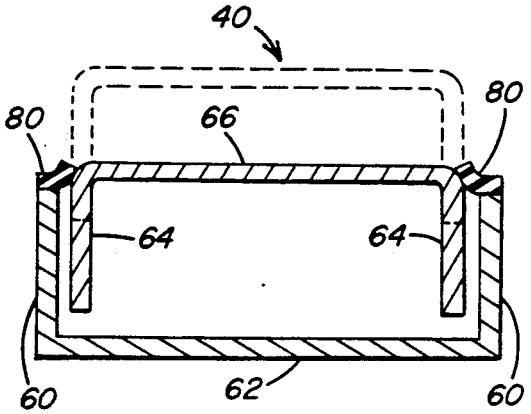
FIG. 6 is a view in cross section of one embodiment of an expandable duct with a scraper seal positioned on the first set of vertical side walls and illustrating in phantom the duct in the expanded state.

In the embodiment of FIG. 6, the duct assembly 40 has a first set of vertical walls 60 connected to and spaced by a horizontal bottom wall 62 and a second set of vertical walls 64 set channel-like into the first set of vertical walls 60, which are connected to and spaced by a horizontal top wall 66. Scraper seals 80 prevent the leakage of dust entrained air while the continuous miner is operating. The second set of vertical walls 64 may be lowered or raised by mechanical means to increase duct 40 cross section as illustrated in phantom in FIG. 6.

Figure 7:
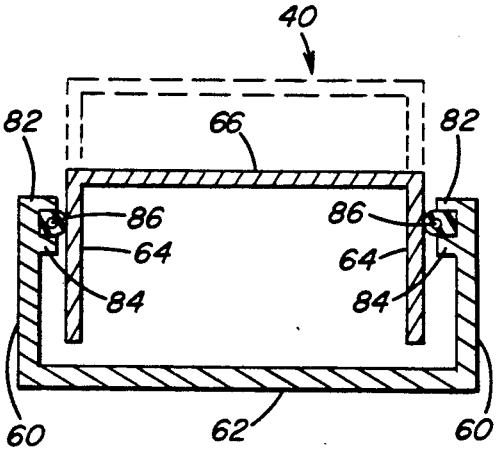
FIG. 7 is a view in cross section of one embodiment of an expandable duct with an inflatable seal and illustrating in phantom the duct in the expanded state.

In the embodiment of FIG. 7, the duct assembly 40 has a first set of vertical walls 60 connected to and spaced by a horizontal bottom wall 62 and a second set of vertical walls 64 set channel-like into the first set of vertical walls 60 and connected to and spaced by a horizontal top wall 66. The first set of vertical walls 60 have inwardly directed lip portions 82 and 84 parallel to each other and at 90° to the first set of vertical walls 60. The vertical walls 60 contain inflatable seals 86 to prevent the leakage of dust-laden air while the continuous miner is in operation. The second set of vertical walls 64 may be raised or lowered by mechanical means. The second set of vertical walls 64 are shown raised in phantom in FIG. 7.

Figure 8:
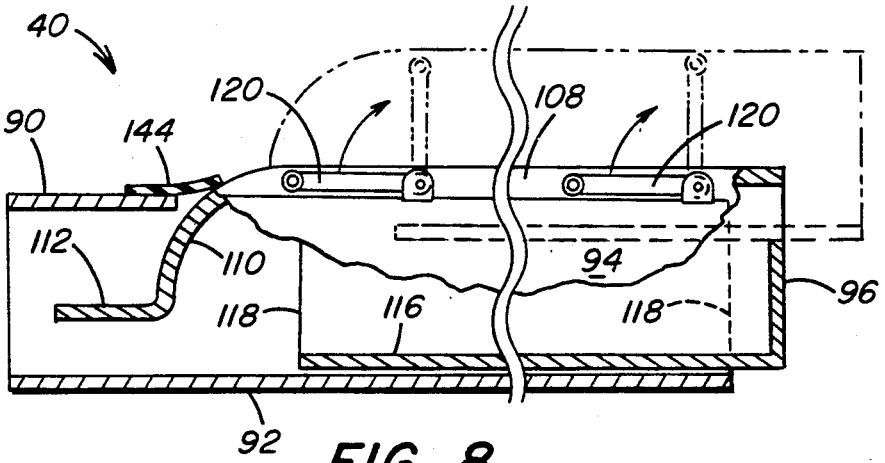
FIG. 8 is a view in cross section of a duct system with a cut-out portion having an end wall and side walls, which can be moved forwardly and upwardly, that has a bottom plate for separating the duct into two channels in the expanded position, and illustrating in phantom the cut-out portion in the expanded position.

As shown in the embodiment of FIG. 8 duct assembly 40 has a horizontal top wall 90, a horizontal bottom wall 92, vertical side walls 94, and an end wall 96. The embodiment of the duct section 40 in FIG. 8 has a cutout portion 108 in top wall 90. The cutout section 108 has an arcuate end wall 110 opposite the fan assembly 38 and an end wall extension 112 parallel to the top wall 90 of the duct section 40. The end wall 110 is connected to side walls (not shown) of the cutout section 108 and the side walls are also attached to the cutout portion 108. A scraper seal 114 prevents leakage of the dust-entrained air from the interior of the intake duct section 40. A closure plate 116 is parallel to the cutout portion 108 and is connected to the cutout portion 108 by means of rods 118. Levers 120 hold the cutout portion 108 in place and rotate the cutout portion 108 upwardly and rearwardly to connect the cutout portion 108 with the fan assembly 38 or with ducting connected to the fan assembly 38. The closure plate 116 divides the interior of the transition duct 108 into two chambers when the cutout portion 108 is moved upwardly and forwardly. Closure plate 116 is advantageously utilized to divide the interior of duct assembly 40 into two channels, an upper channel and a lower channel. The upper channel may be utilized to conduct dust entrained air from duct assembly 40 upstream of crossover portion 51. The lower channel may be utilized to conduct dust entrained air received through cross-over portion 51.

Figure 9:
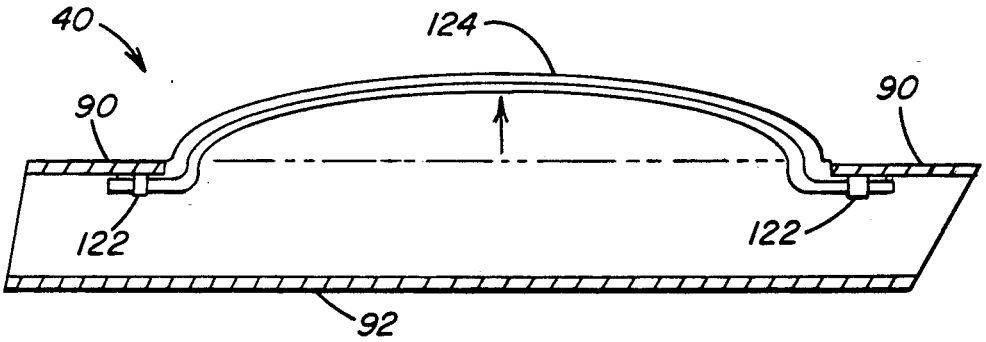
FIG. 9 is a view in cross section of an expandable duct with a cut-out portion replaced with an expandable flexible material to increase the duct cross section.

In the embodiment in FIG. 9, intake duct section 40 has a horizontal top wall 90, a horizontal bottom wall 92, and vertical side walls (not shown). The top wall 90 has a cutout area with a flexible covering 124 attached to the top wall 90 by clamps 122. The flexible covering 124 is raised when the fan assembly 38 draws air through the interior of duct assembly 40 by inflatable ribs or other mechanical means (not shown) to increase the cross section of intake duct 40.

Figure 10:
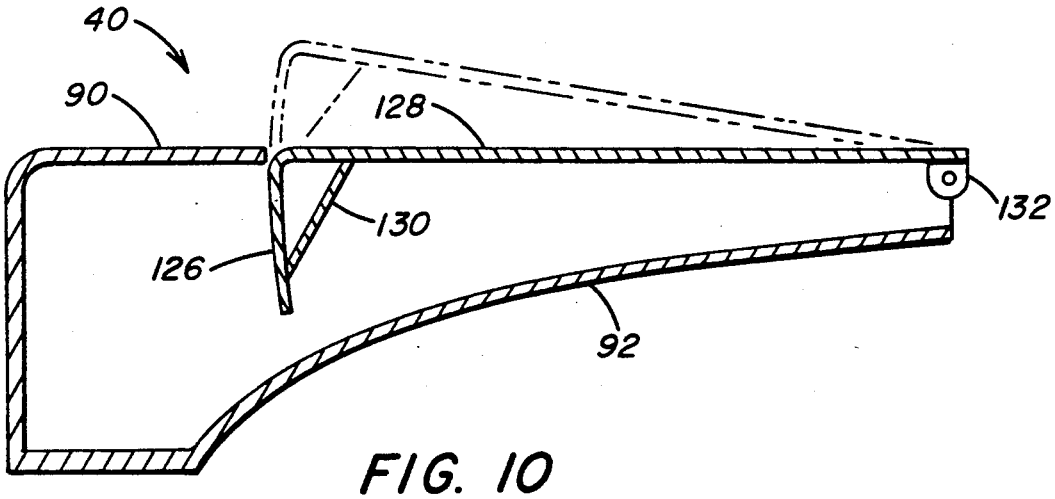
FIG. 10 is a view in cross section of an expandable duct system with a hinged top portion with end and side walls connected to the hinged top portion to increase the duct cross section and illustrating in phantom the expanded state of the duct.

In the embodiment of FIG. 10, duct assembly 40 has a generally horizontal bottom wall 92, vertical side walls (not shown), a horizontal top wall 90 and a cutout portion 128. The cutout portion 128 of the horizontal top wall 90 has an end portion 126 which is reinforced by a reinforcing member 130. The cutout portion 128 is attached to the horizontal top wall 90 by means of a hinge 132, allowing the cutout portion 128 to rotate around the hinge 132 and to expand outwardly to increase the cross section of the interior of intake duct assembly 40.

Figure 11:
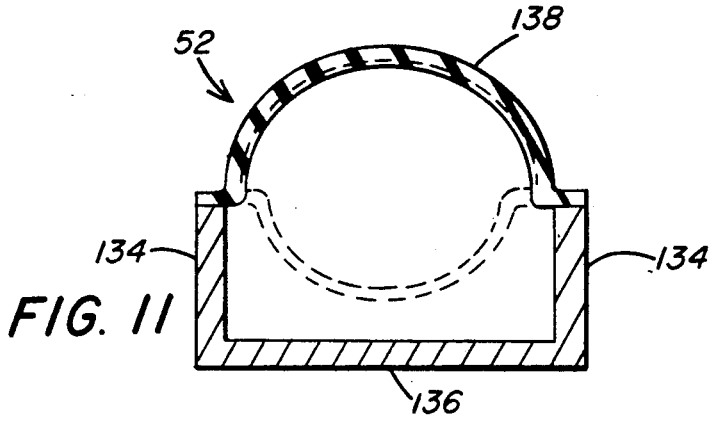
FIG. 11 is a view in cross section of another expandable duct with a flexible top and illustrating in phantom the unexpanded state of the duct.

In the embodiment of FIG. 11, the rear crossover duct assembly 52 passes beneath the conveying reach 56 and the return reach 58 of the conveying means 54 at the rear end 24 of the mining machine 10 as illustrated in FIGS. 1 and 2. The crossover duct assembly 52 is connected to the fan assembly 38 by the transition portion 50 of the duct assembly 40 and crosses the rear end 24 of the mining machine 10 to exhaust air from the scrubber to either side of mining machine 10 by means of gates 100 and 102 pivotally connected at 104 and 106. The crossover duct assembly 52 has a set of vertical side walls 134 connected to and spaced by a horizontal bottom wall 136. A flexible covering 138 is attached by clamps (not shown) to the ends of the vertical side walls 134 opposite the horizontal bottom wall 136. The force of air conveyed by the fan assembly 38 reaches the flexible covering and expands the crossover duct assembly 52 cross section. The flexible covering 138 may also be raised by inflatable ribs or other mechanical means.

Figure 12:
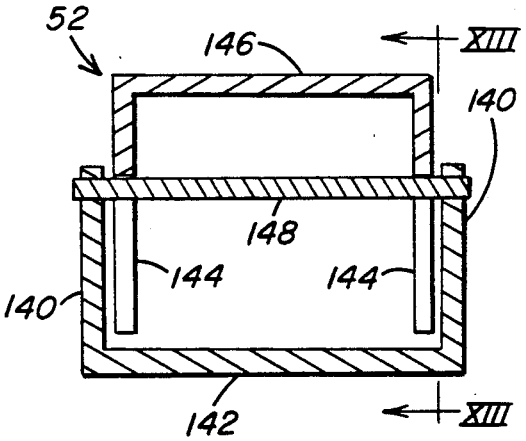
FIG. 12 is a view in cross section of an expandable duct with a first set of vertical side walls receiving channel-like a second set of vertical walls and illustrating the cross supports in the first set of vertical walls positioned in cut-out portions of the second set of vertical walls.
Figure 13:
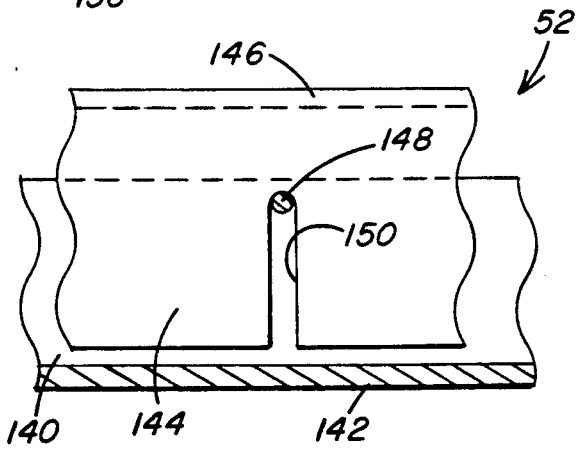
FIG. 13 is a fragmentary longitudinal section of the expandable duct shown in FIG. 12 and illustrating the slots formed in the second set of vertical side walls of the duct for receiving the cross-supports on the side walls of the first set of vertical side walls and illustrating in phantom the area of expansion of the duct assembly.

In the embodiment of FIGS. 12 and 13 is the crossover duct assembly 52 which crosses the rear end 24 of the mining machine 10 beneath the conveyor reach 56 and the conveyor reach return 58 of the conveying means 54, and which is attached to mobile frame assembly 12. The crossover duct assembly 52 has a first set of vertical side walls 140 connected to and spaced by a horizontal bottom wall 142 and a second set of vertical walls 144 fitting channel-like into the first set of vertical walls 140. The second set of vertical walls 144 are spaced by and connected to the horizontal top wall 146. The first set of vertical side walls 140 has at regular intervals support cross bars 148 at the end of the first set of vertical side walls 140 furthest from the horizontal bottom wall 142. The second set of vertical side walls 144 has cutouts 150 at the same regular intervals as the support cross bars 148 to accomodate the support cross bars 140 and to allow the second set of vertical walls 144 to fit channel-like into the first set of vertical walls 140. The cross section of the duct 52 may be increased by raising the second set of vertical side walls 144 by hydraulic pistons or other mechanical means. The support cross bars 148 add support to the first set of vertical side walls 140 of the crossover duct 52.

According to the provisions of the Patent Statutes, we have explained the principal, preferred construction and mode of operation of our invention and have illustrated and described what we now consider to represent its best embodiments. However, it should be understood that, within the scope of the appended claims, the invention may be practiced otherwise than as specifically illustrated and described.

We claim:

1. A continuous miner comprising, a mobile frame assembly having a front end portion and a rear end portion, dislodging means for dislodging material from a mine face, said dislodging means connected to said mobile frame assembly front end portion, conveying means connected to said mobile frame assembly for receiving material dislodged by said dislodging means and conveying said dislodged material to said frame assembly rear end portion, collecting means including a fan assembly and duct assembly positioned on said mobile frame assembly for inducing a flow of air through said duct assembly from said frame assembly front end portion to said rear end portion, said fan assembly having an intake end and an exhaust end, said duct assembly having an end portion connected to said fan assembly intake end and an opposite end portion, said duct assembly opposite end portion connected with an inlet for collecting dust-entrained air, and means for increasing and decreasing the cross sectional area of at least a portion of said duct assembly to increase the capacity of said duct assembly during operation of said continuous miner and to reduce the cross section of at least a portion of said duct assembly while moving said mining machine in the mine.

2. The continuous miner as set forth in claim 1 wherein, said duct assembly including a first pair of vertically extending side walls spaced from each other and a horizontal bottom wall connected to said first set of vertical walls and a second set of vertically extending side walls spaced from each other and set channel-like into said first set of vertical walls and a horizontal top wall connected to said second set of vertical side walls, said first set of vertical walls having a proximal end and a distal end, said proximal end being connected to said horizontal bottom wall and said distal end being furthest from said horizontal bottom wall, said first set of vertical walls having an interior surface and an exterior surface, said interior surface facing said second set of vertical walls and said exterior surface facing away from said second set of vertical walls, and said second set of vertical walls arranged to be moved upwardly from within said first set of vertical walls to increase the cross section of at least a portion of said duct assembly.

3. The continuous miner as set forth in claim 2 wherein, a third set of vertical walls being parallel to and adjacent said interior surface of said first set of vertical walls, said third set of vertical walls connected to said horizontal bottom wall, inflatable bladders positioned in the space between said first set of vertical walls and said third set of vertical walls, said second set of vertical walls fitting channel-like between said first set of vertical walls and said third set of vertical walls, and said second set of vertical walls being pushed up from between said first set of vertical walls and said third set of vertical walls by said inflatable bladder to expand the cross section of said duct when said inflatable bladder is inflated.

4. The continuous miner as set forth claim 2 wherein, said distal end of said first set of vertical walls having inwardly facing scraper seals in contact with said second set of vertical walls and sealing the interior of said duct from the outside atmosphere.

5. The continuous miner as set forth in claim 2 wherein, said second set of vertical walls having an interior surface and an exterior surface, said interior surfaces of said second set of vertical walls facing each other and said second set of vertical walls exterior surfaces facing the interior surfaces of said first set of vertical walls, and a rolling seal attached to said interior wall of said first set of vertical walls and extending to and connected to said interior surface of said second set of vertical walls.

6. The continuous miner as set forth in claim 2 wherein, said first set of vertical walls having on their distal end lips directed medially toward said second set of vertical walls, said second set of vertical walls having on their distal ends lips directed outwardly toward said first set of vertical walls, and a gasket being attached to said lip on said first set of said vertical walls.

7. The continuous miner as set forth in claim 2 wherein, said first set of vertical walls include inwardly directed first lip portions at said distal ends, spaced from and below said first lip portion a second lip portion parallel to said first lip portion and spaced from and below said first lip portion, and an inflatable seal positioned in the space between said first lip portion and said second lip portion.

8. The continuous miner as set forth in claim 1 wherein, said duct assembly having two spaced vertical side walls connected to a horizontal top wall and a horizontal bottom wall, said top wall having a movable portion connected to said top wall by a hinge, means for moving said movable portion relative to said top wall around said hinge to increase the cross section of said duct, said movable portion of said top wall having a proximal end and a distal end, said proximal end being closest to said hinge and said distal end being furthest from said hinge, and said distal end of said movable portion of said top wall having an end wall and side walls connected to said end wall portion, said end wall portion extending into the interior of said duct assembly when said movable portion is in a downward position.

9. The continuous miner as set forth in claim 1 wherein, a portion of said duct assembly having two spaced vertical side walls connected to a horizontal bottom wall, a flexible top portion connected to said vertical side walls at the upper end of said vertical side walls, said upper end of said vertical side walls spaced from said horizontal bottom wall, and said flexible top portion being movable to increase the cross section of said duct assembly.

10. A continuous miner as set forth in claim 1 wherein, a portion of said duct assembly includes a set of vertical side walls spaced by and connected to a horizontal bottom wall, said vertical walls having a proximal end connected to said horizontal bottom wall, and a distal end spaced from said horizontal bottom wall, said distal end of said vertical side walls having connected thereto a flexible covering, and said flexible covering having portions movable relative to said vertical side walls to increase the cross section of said portion of said duct assembly.

11. The continuous miner as set forth in claim 1 wherein, said duct assembly having a set of vertical walls spaced by and connected to a horizontal top wall and a horizontal bottom wall, said horizontal top wall having a cutout portion connected to said horizontal top wall by connecting and moving means, said cutout portion having a plate spaced from and generally parallel to said cutout portion, and means to move said cutout portion from said top wall to expand said duct assembly and to divide the interior of said duct assembly into two channels by means of said plate.

12. A method of increasing duct cross section in a continuous mining machine comprises, providing a first set of vertical walls spaced by and connected to a horizontal bottom wall, providing a second set of vertical walls spaced by and connected to a horizontal top wall, positioning said second set of vertical walls channel-like into said first set of vertical walls, and raising said second set of vertical walls from within said first set of vertical walls to increase said cross section of said duct.

13. A method of increasing duct cross section in a continuous mining machine comprises, providing a first set of vertical walls spaced by and connected to a horizontal bottom wall, attaching a flexible covering to the end of said vertical walls furthest from said horizontal bottom wall, and expanding said flexible covering to increase the cross section of said duct assembly.

* * * * *